US011946682B1

(12) United States Patent
Hertz et al.

(10) Patent No.: US 11,946,682 B1
(45) Date of Patent: Apr. 2, 2024

(54) WATER CIRCULATION FOR ICE MAKER IN WATER DISPENSER

(71) Applicant: Quench USA, Inc., King Of Prussia, PA (US)

(72) Inventors: Theodore Hertz, Lower Gwynedd, PA (US); Andrew Troy Nuttall, Queen Creek, AZ (US)

(73) Assignee: QUENCH USA, INC., King of Prussia, PA (US)

( * ) Notice: Subject to any disclaimer, the term of this patent is extended or adjusted under 35 U.S.C. 154(b) by 0 days.

(21) Appl. No.: 18/206,773

(22) Filed: Jun. 7, 2023

(51) Int. Cl.
*F25C 1/25* (2018.01)

(52) U.S. Cl.
CPC ..... *F25C 1/25* (2018.01); *F25C 2400/12* (2013.01); *F25C 2400/14* (2013.01); *F25C 2700/04* (2013.01)

(58) Field of Classification Search
CPC .... F25C 1/25; F25C 2400/12; F25C 2400/14; F25C 2700/04
USPC ..... 62/66, 344, 379, 135, 391, 351, 137
See application file for complete search history.

(56) References Cited

U.S. PATENT DOCUMENTS 2,963,885 A * 12/1960 Loewenthal ..... F25C 1/12 62/391
3,969,909 A * 7/1976 Barto ..... F25C 1/25 62/340
4,207,994 A * 6/1980 Offlee, Sr. ..... F25D 23/126 222/63
4,319,698 A * 3/1982 Tomiyama ..... G07F 13/065 62/400
4,370,865 A * 2/1983 Hibino ..... F25C 1/12 62/347
4,448,032 A * 5/1984 Hibino ..... F25C 1/12 414/269

(Continued)

FOREIGN PATENT DOCUMENTS

JP H0674626 A * 3/1994
JP H08261522 A * 10/1996

(Continued)

OTHER PUBLICATIONS

JPH0674626a, machine translation (Year: 2023).*

(Continued)

*Primary Examiner* — Eric S Ruppert
*Assistant Examiner* — Kirstin U Oswald
(74) *Attorney, Agent, or Firm* — Panitch Schwarze Belisario & Nadel LLP

(57) ABSTRACT

A water-dispensing device includes a reservoir tank, a dispense pump, one or more dispense valves, a spigot in selective fluid communication with the reservoir tank via at least the dispense pump and the dispense valves, an ice maker, an ice making, and an ice tank. The ice tank includes a melt tray in fluid communication with the ice maker. A melt pump is connected between the melt tray and the reservoir tank. A controller is configured to, upon receiving a signal to perform a water dispensing operation: (a) open one of the one or more dispense valves, (b) activate the dispense pump to move water from the reservoir tank toward the spigot, (c) if the ice making valve is not open, open the ice making valve, and (d) activate the melt pump to move water from the melt tray toward the reservoir.

18 Claims, 3 Drawing Sheets

(56) References Cited

U.S. PATENT DOCUMENTS 5,350,082 A * 9/1994 Kiriakides, Jr. ..... G07F 13/10 221/96
5,549,219 A * 8/1996 Lancaster ..... B67D 1/0857 222/1
5,564,601 A * 10/1996 Cleland ..... F28D 7/08 62/185
5,950,866 A * 9/1999 Lancaster ..... B67D 1/0857 62/434
6,460,367 B1 * 10/2002 DuHack ..... F25D 23/126 62/340
9,273,894 B1 * 3/2016 Whitty ..... F25C 1/00
2003/0024263 A1 * 2/2003 Mitchell ..... F25C 1/12 62/340
2004/0216474 A1 * 11/2004 Jablonski ..... F25C 1/12 222/146.6
2011/0041542 A1 * 2/2011 Brunner ..... F25C 1/00
2016/0370061 A1 * 12/2016 Erbs ..... A61L 2/183
2017/0245675 A1 * 8/2017 Junge ..... B65D 85/8043
2017/0370628 A1 * 12/2017 Knatt ..... F25C 1/25
2018/0017304 A1 * 1/2018 Knatt ..... F25C 1/045
2022/0221212 A1 * 7/2022 Carr ..... F25C 5/22

FOREIGN PATENT DOCUMENTS

JP H09324973 A * 12/1997
KR 101507037 B1 * 4/2015
WO WO-2008156287 A1 * 12/2008 ..... F25C 1/08

OTHER PUBLICATIONS

JPH08261522a, machine translation (Year: 2023).*
JP H09324973 A, machine translation (Year: 2023).*
KR101507037b1, machine translation (Year: 2023).*

* cited by examiner

WATER CIRCULATION FOR ICE MAKER IN WATER DISPENSER

BACKGROUND

Embodiments described herein relate generally to an ice maker in a water dispenser, and more particularly, to circulating water through an ice maker.

Some water dispensers may be equipped with an ice maker. Such ice makers typically can include an evaporator and an auger to form and move ice into an ice tank where the ice can be retrieved by a user, often through a vertical dispensing funnel. The ice maker may be fed by a reservoir tank. Melt water from ice in the ice tank may be collected by a melt tray at the bottom of the ice tank. In units advertised as "drainless"—systems that do not connect to a drain for emptying melt water or other overflow—when the melt tray is full, a pump can evacuate the melt tray and feed the melt water back to the reservoir tank for later re-use in the ice maker. However, the ice maker has no connection to the pump or the ice tank other than to deliver finished ice, and water ends up sitting stagnant in the ice maker. Over time, minerals can build up in the ice maker, causing scale and potential failure of the system due to damage to the auger or the like.

It is desirable to provide a water dispenser that is capable of circulating water through the ice maker in a drainless-capable operation to avoid mineral build-up.

BRIEF SUMMARY

Briefly stated, one embodiment comprises a water-dispensing device including a reservoir tank, a dispense pump connected to the reservoir tank, one or more dispense valves downstream of the dispense pump, a spigot in selective fluid communication with the reservoir tank via at least the dispense pump and the one or more dispense valves, an ice maker, an ice making valve disposed between the reservoir tank and the ice maker to enable selective fluid communication from the reservoir tank to the ice maker, and an ice tank configured to receive and store ice made by the ice maker. The ice tank includes a melt tray that is in fluid communication with the ice maker. A melt pump is connected between the melt tray and the reservoir tank. A controller is configured to, upon receiving a signal to perform a water dispensing operation: (a) open one of the one or more dispense valves, (b) activate the dispense pump to move water from the reservoir tank toward the spigot, (c) if the ice making valve is not open, open the ice making valve, and (d) activate the melt pump to move water from the melt tray toward the reservoir.

In one aspect, the one or more dispense valves includes a first dispense valve and a second hot water dispense valve. In a further aspect, a hot water tank is located between the reservoir tank and the second hot water dispense valve. The dispense pump is located between the reservoir tank and the hot water tank. The hot water tank is in selective fluid communication with the second hot water dispense valve. In a still further aspect, a control valve is located between the dispense pump and the hot water tank. The controller is configured to open the control valve when the water dispensing operation is a hot water dispensing operation.

In another aspect, a fill valve is located upstream of the reservoir tank. The fill valve is configured to place the reservoir tank in selective fluid communication with a water source. In a further aspect, the reservoir tank includes a level sensor. In a still further aspect, the controller is further configured to, upon receiving a signal from the level sensor in the reservoir tank indicating a low level condition, open the fill valve to allow water from the water source to enter the reservoir tank.

In still another aspect, the melt tray includes a level sensor. In a further aspect, the controller is further configured to, in response to receiving a signal from the level sensor in the melt tray indicating a level of water in the melt tray has exceeded a predetermined level, activate the melt pump to move water from the melt tray to the reservoir tank. In a still further aspect, the controller is further configured to, upon determining that the water dispensing operation is complete: (i) deactivate the dispense pump and the melt pump, (ii) close the one of the one or more dispense valves, and (iii) leave the ice making valve open at least until receiving a signal from the level sensor in the melt tray indicating that the melt tray is full.

In yet another aspect, a drain pump is connected to the ice maker and connectable to a drain. In a further aspect, the controller is further configured to periodically activate the drain pump to move water from the ice maker toward the drain.

Another embodiment comprises a method of operating a water-dispensing device including a reservoir tank, a dispense pump, one or more dispense valves downstream of the dispense pump, a spigot, an ice maker, an ice making valve disposed between the reservoir tank and the ice maker to enable selective fluid communication therebetween, an ice tank having a melt tray in fluid communication with the ice maker, a melt pump, and a controller. The method includes, in response to receiving, by the controller, a signal to perform a water dispensing operation: opening, by the controller, one of the one or more dispense valves, activating, by the controller, the dispense pump to move water from the reservoir tank toward the spigot, checking, by the controller, a status of the ice making valve and, if the ice making valve is closed, opening the ice making valve, and activating, by the controller, the melt pump to move water from the melt tray toward the reservoir.

In one aspect, the water-dispensing device further includes a hot water tank. The method further includes, when the water dispensing operation is a hot water dispensing operation, opening a control valve located between the dispense pump and the hot water tank.

In another aspect, the method further includes, upon receiving a signal from a level sensor in the reservoir tank indicating a low level condition, opening, by the controller, a fill valve to allow water from a water source to enter the reservoir tank.

In yet another aspect, the method further includes, upon receiving a signal from a level sensor in the melt tray indicating a level of water in the melt tray is too high, activating, by the controller, the melt pump to move water from the melt tray to the reservoir tank.

In still another aspect, the method further includes, upon determining, by the controller, that the water dispensing operation is complete: deactivating the dispense pump and the melt pump, closing the one of the one or more dispense valves, and leaving the ice making valve open at least until receiving a signal from a level sensor in the melt tray indicating that the melt tray is full.

In yet another aspect, the water-dispensing device includes a drain pump connected to the ice maker. The method further includes activating, by the controller on a periodic basis, the drain pump to move water from the ice maker toward the drain.

BRIEF DESCRIPTION OF THE SEVERAL VIEWS OF THE DRAWINGS

The following detailed description of preferred embodiments will be better understood when read in conjunction with the appended drawings. For the purpose of illustration, there are shown in the drawings embodiments which are presently preferred. It should be understood, however, that the invention is not limited to the precise arrangements and instrumentalities shown.

In the Drawings.

DETAILED DESCRIPTION

Figure 1B:
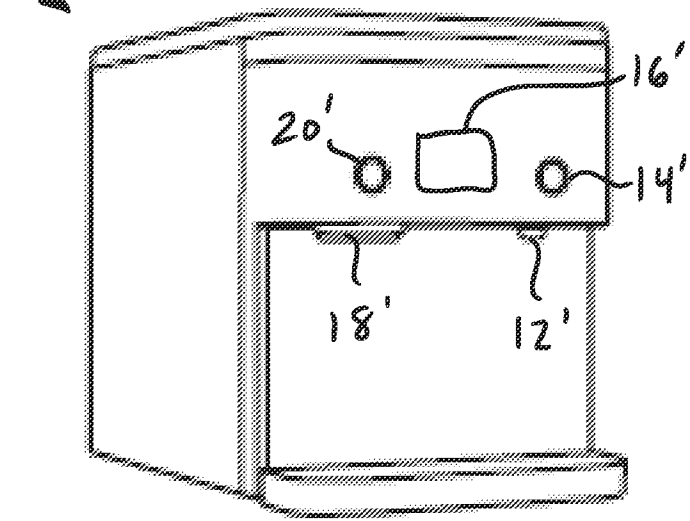
FIG. 1B is a front side perspective view of a water-dispensing device in accordance with a second example embodiment of the present invention.

Certain terminology is used in the following description for convenience only and is not limiting. The words "right", "left", "lower", and "upper" designate directions in the drawings to which reference is made. The words "inwardly" and "outwardly" refer to directions toward and away from, respectively, the geometric center of the device and designated parts thereof. The terminology includes the above-listed words, derivatives thereof, and words of similar import. Additionally, the words "a" and "an", as used in the claims and in the corresponding portions of the specification, mean "at least one."

It should also be understood that the terms "about," "approximately," "generally," "substantially" and like terms, used herein when referring to a dimension or characteristic of a component, indicate that the described dimension/characteristic is not a strict boundary or parameter and does not exclude minor variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

Figure 1A:
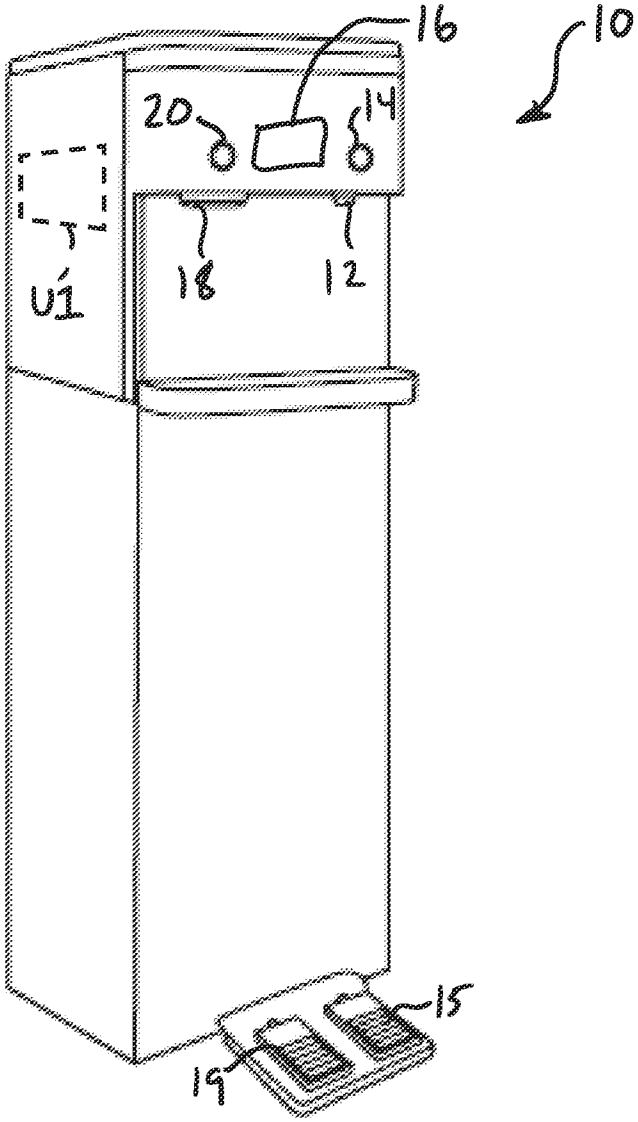
FIG. 1A is a front side perspective view of a water-dispensing device in accordance with a first example embodiment of the present invention.

Referring to FIG. 1A, there is shown a first example embodiment of a water-dispensing device 10 in accordance with the present invention. FIG. 1A depicts a free-standing water-dispensing device 10. The water-dispensing device 10 may have a spigot 12 for dispensing water into a vessel (not shown), such as a cup, glass, or the like. In this example, the water-dispensing device 10 includes a water dispensing actuator 14 in the form of a pushbutton. However, the water dispensing actuator 14 may take other forms as well, such as a touch screen element or icon, a touch-free sensor (e.g., for bringing a hand or finger in proximity to the sensor for hygienic operation), or the like. Actuation of the pushbutton 14 may initiate a dispensing operation from the spigot 12. A foot pedal 15 may be provided as an additional or alternative water dispensing actuator, which can allow water dispensing in a hands-free manner.

In this example, only a single spigot 12 and water dispensing actuator 14 are shown. In embodiments where the water-dispensing device 10 is configured to dispense water at selectable different temperatures (e.g., warm, ambient, and/or cold) or provides options for water selection (e.g., flavors, filters, sparkling, or the like), an operation panel 16 may be provided to enable selections by the user of various options for the water. The operation panel 16 may include mechanical buttons, switches, or the like, be a touchscreen or touch-free panel, combinations thereof, or the like. In alternative embodiments, the water-dispensing device 10 may provide multiple spigots and actuators (not shown).

The water-dispensing device 10 may further have a funnel 18 for dispensing ice into a vessel (not shown), such as a cup, glass, ice bucket, or the like. In this example, the water-dispensing device 10 includes an ice dispensing actuator 20 in the form of a pushbutton. However, the ice dispensing actuator 20 may take other forms as well, such as a touch screen element or icon, a touch-free sensor, or the like. Actuation of the pushbutton 20 may initiate a dispensing operation from the funnel 18. A foot pedal 19 may be provided as an additional or alternative ice dispensing actuator, which can allow ice dispensing in a hands-free manner. In embodiments where selections are available for ice (e.g., changing the shape, size, consistency, or the like), the operation panel 16 may be used to enable the user to make such choices. However, in other embodiments, a separate operation panel (not shown) may be provided specifically for the ice dispensing operations of the water-dispensing device 10.

While the water-dispensing device 10 is shown in FIG. 1A as being free-standing, the water-dispensing device 10 may be of any conventional type in keeping within the spirit and scope of the invention, such as a countertop dispenser, a built-in (e.g., cabinet-mounted) dispenser, or the like. For example, FIG. 1B shows a countertop-type water-dispensing device 10' that may be used for embodiments described herein, and may similarly include a spigot 12', water dispensing actuator 14', operation panel 16', funnel 18', and ice dispensing actuator 20'.

Figure 2:
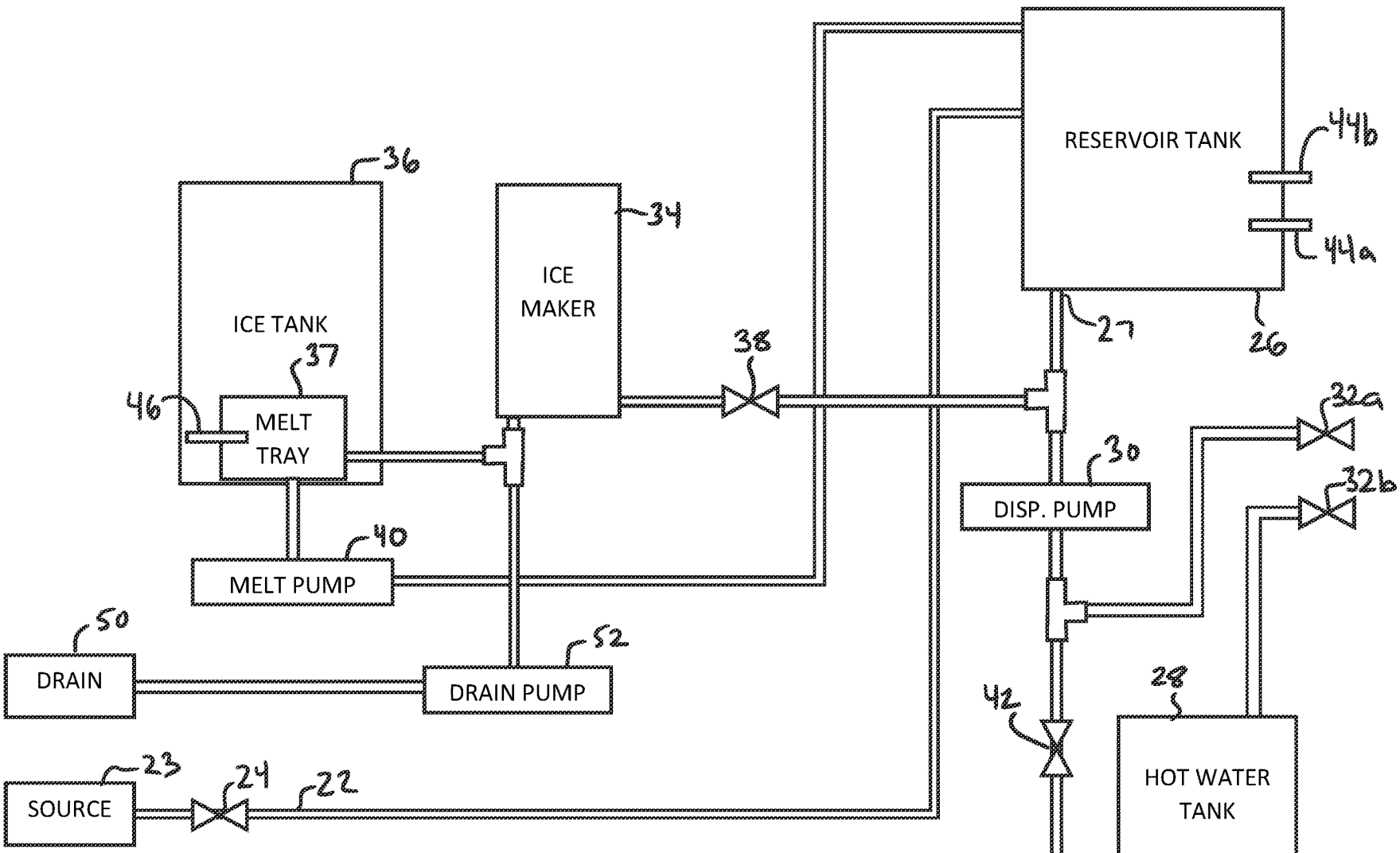
FIG. 2 is a schematic plumbing diagram of the water-dispensing device of FIG. 1A.

Referring to FIG. 2, the water-dispensing device 10 may include a water intake 22 that may be directly or indirectly connected to a water source 23, such as a building water supply, a container, or any other like source of water. One or more filters (not shown) may be located downstream of the water source 23 in order to filter water before it is stored in the water-dispensing device 10 and/or prior to dispensing through the spigot 12. For example, the filters may be sediment, carbon, reverse osmosis, ultra filtration, and/or other like types of filters. One or more fill valves 24 may be used with the water intake 22 to control filling operations. The fill valve 24 may be a solenoid valve or other type of electrically-actuated valve.

The water source 23 may be in selective fluid communication with a reservoir tank 26 via the fill valve 24 and water intake 22. The reservoir tank 26 is preferably configured to store water for both water dispensing and ice making operations, as will be described in further detail below. The reservoir tank 26 may be insulated to maintain the water contained therein at a preferred temperature, although the reservoir tank 26 may also include equipment (not shown) for chilling the water contained therein, as is conventionally known. In other embodiments, a separate chilling tank (not shown) may be provided for cold water. The reservoir tank 26 shown in FIG. 2 may be capable of storing up to 20 ounces of water, although other volumes may be used as well.

In embodiments where the water-dispensing device 10 dispenses hot water, a hot water tank 28 may also be provided. The hot water tank 28 may be configured to store water at a temperature over 160° F. (or other desired temperature) and may be insulated and include equipment (not shown) for heating water contained therein, as is conventionally known. The hot water tank 28 shown in FIG. 2 may be capable of storing up to 1.5 Liters of hot water, although other volumes may be used as well. The hot water tank 28 may be supplied with water from the reservoir tank 26, as will be explained in further detail below. However, in other embodiments, the hot water tank 28 may be directly supplied from the water source 23. In still other embodiments, a hot water tank 28 may be omitted and water from the reservoir tank 26 may be routed through a heat exchanger or other heating equipment (not shown) prior to dispensing.

As shown in FIG. 2, the reservoir tank 26 may be connected to a dispense pump 30, which may be configured for moving water from the reservoir tank 26 toward the spigot 12. One or more dispense valves 32*a*, 32*b* may be located downstream of the dispense pump 30. The first dispense valve 32*a* shown in FIG. 2 controls dispensing of ambient or cold water from the reservoir tank 26. The second or hot dispense valve 32*b* shown in FIG. 2 controls dispensing of hot water from the hot water tank 28. The dispense valve(s) 32*a*, 32*b* may be solenoid valves or other types of electrically-actuated valves. As the water-dispensing device shown in FIG. 1A has a single spigot, the two dispense valves 32*a*, 32*b* may lead to a common dispensing wye (not shown) outputting to the spigot 12. However, in embodiments where separate spigots are provided, each dispense valve 32*a*, 32*b* may be associated with its own spigot. In the example shown in FIG. 2, there is a single dispense pump 30 that feeds both the first dispense valve 32*a* and the hot water tank 28 en route to the second hot dispense valve 32*b*. However, the connections to the reservoir tank 26 may be separate and multiple dispense pumps 30 may be provided in such embodiments.

The reservoir tank 26 may also be connected to an ice maker 34 and configured to supply water to the ice maker 34 for creation of ice. The ice maker 34 may have an evaporator and auger (not shown). When ice is ready, the auger may move the created ice from the ice maker 34 to an ice tank 36 provided in the water-dispensing device 10. An ice making valve 38 may be disposed between the reservoir tank 26 and the ice maker 34 to enable selective fluid communication from the reservoir tank 2 to the ice maker 34. For example, when the ice maker 34 is not making ice, the ice making valve 38 may be closed such that no water is present in the ice maker 34. The ice making valve 38 may be a solenoid valve or other type of electrically-actuated valve. The ice maker 34 may be fed by vertically positioning the ice maker 34 to allow the water levels in the reservoir tank 26 and the ice maker 34 to reach an equilibrium when the ice making valve 38 is open, although in other embodiments, a pump (not shown) may be used to move water from the reservoir tank 26 to the ice maker 34.

The ice tank 36 may include a melt tray 37 that may be disposed in a position below or at the bottom of the ice tank 36 for retaining water generated by ice melting in the ice tank 36. The melt tray 37 may further be in fluid communication with the ice maker 34. The melt tray 37 in FIG. 2 may have a capacity of between ½ to 1 L when full, although other volumes may be used as well. In the embodiment shown, the melt tray 37 may be located below a height of the ice maker 34 to allow a constant flow of water from the ice maker 34 into the melt tray 37, although in some embodiments, a pump (not shown) may be used for this purpose. In still other embodiments, the ice maker 34 may, itself, reside in a portion of the melt tray 37. The melt tray 37 may be connected to a melt pump 40 that is configured to move water from the melt tray 37 toward the reservoir tank 26. In this manner, water from the melted ice in the ice tank 36 and water flowing directly to the melt tray 37 from the ice maker 34 may be recycled to the reservoir tank 26 for re-use either in dispensed water or for making more ice.

Various operations and processes of the water-dispensing device 10, for example, manipulation of the fill valve 24, the one or more dispense valves 32*a*, 32*b*, the ice making valve 38, and/or other valves, operating heating or chilling elements (not shown), actuating the dispense pump 30, the melt pump 40, and/or other pumps, and/or the like, may be performed by at least one controller U1 (FIG. 1A), which may be a microcontroller unit (MCU), a central processing unit (CPU), a microprocessor, an application specific controller (ASIC), a programmable logic array (PLA), combinations thereof, or the like. The controller U1 may include or be coupled to a memory (not shown) that may store code or software for carrying out processes described herein and/or carrying out other operations of the water-dispensing device 10 and may store any captured data for later transfer to remote or external devices. It should be further appreciated that although controller U1 is referred to in this example as a single component, the controller U1 may include a plurality of individual devices, with control functions divided among the individual devices. The controller U1 may be wired or wirelessly connected to components of the water-dispensing device 10 necessary for carrying out the operations and processes described herein.

Figure 3:
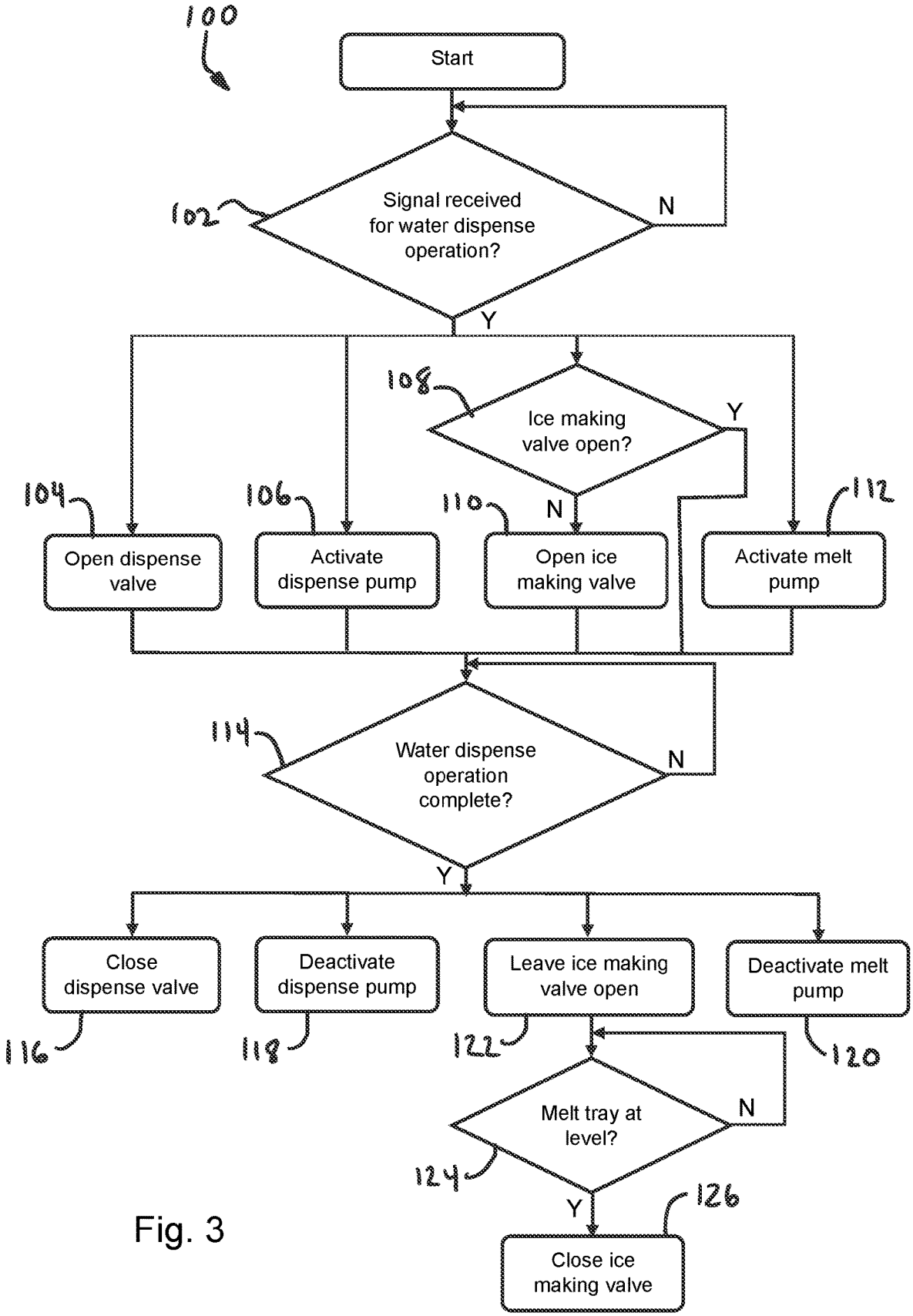
FIG. 3 is a flow chart illustrating an example method performed by a controller of the water-dispensing device of FIG. 1A for a water dispensing operation.

FIG. 3 shows an example of a method 100 that may be performed by the controller U1 for dispensing water. At step 102, the controller U1 determines a signal has been received for a water dispensing operation. For example, actuation of the water dispensing actuator 14 by a user may send a signal to the controller U1 that a water dispensing operation has been requested. When such a signal is received, the controller U1 may undertake the following steps. At step 104, the controller U1 may open the corresponding dispense valve 32*a*, 32*b*. For example, if hot water has been selected, the controller U1 may open the second hot dispense valve 32*b*. If ambient water is selected instead, the controller U1 may open the first dispense valve 32*a*.

At step 106, the controller U1 may activate the dispense pump 30 to move water from the reservoir tank 26 toward the spigot 12. In the embodiment shown in FIG. 2, a control valve 42 may be positioned between the dispense pump 30 and the hot water tank 28. The control valve 42 may be a solenoid valve or other type of electrically-actuated valve and may be used to prevent pressure from building on the hot water tank 28 when ambient or cold water is dispensed via the first dispense valve 32*a*. In that operation, the control valve 42 may be closed. When hot water is requested for dispensing, in conjunction with steps 104 and/or 106 (simultaneously or sequentially), the controller U1 may open the control valve 42 (if not opened already) to allow water from the reservoir tank 26 to be pumped to the hot water tank 28. In operation, cooler water entering the hot water tank 28 from the reservoir tank 26 may force preheated water out of the hot water tank 28 and toward the spigot 12. In some embodiments, where the previously stored and preheated water in the hot water tank 28 has been depleted during a dispensing operation, the operation may be paused by the controller U1 while new water in the hot water tank 28 is heated to an appropriate temperature.

At step 108, the controller U1 may determine whether the ice making valve 38 is open or not. If the ice making valve 38 is found to be in a closed position, at step 110, the controller U1 may open the ice making valve 38. If the controller U1 instead finds that the ice making valve 38 is already open, such as when the ice maker 34 is actively making ice, then step 110 may be skipped. At step 112, the controller U1 may activate the melt pump 40 to move water from the melt tray 37 toward the reservoir tank 26. While steps 104-112 are shown in FIG. 3 as being performed in parallel, the steps can be performed in sequence or in any combination with one another in any order, as practical. For example, the appropriate dispense valve 32*a* may be opened prior to any pump activation, the dispense pump 30 and melt pumps 40 may be activated generally simultaneously, and the like.

As a result, water will be dispensed by the spigot 12 from the reservoir tank 26 (in hot dispensing operations, via the hot water tank 28). Meanwhile, water is circulated between the reservoir tank 26, the ice maker 34, and the melt tray 37 via the ice making valve 38 and the melt pump 40. This circulation allows a drainless flushing of water in the ice maker 34 to reduce problems with mineral build-up in the ice maker 34.

If the dispensing operation is lengthy such that the water in the reservoir tank 26 is depleted below a desired level, the controller U1 may open the fill valve 24 to allow the water source 23 to replenish the reservoir tank 26. The reservoir tank 26 may include one or more level sensors 44*a*, 44*b*, such as float sensors, optical sensors, inductive-type sensors, capacitive-type sensors, combinations thereof, or the like, for detecting a level of water in the reservoir tank 26. Where different water levels may trigger different actions, individual level sensors may be provided at each level. In other embodiments, a single level sensor may be able to detect multiple water levels—such as where a pivotable float may rise with the water level and contact individual pins associated with predetermined water levels. In FIG. 2, a first level sensor 44*a* is shown mounted at a height level below which the controller U1 may determine that the fill valve 24 should be opened to refill the reservoir tank 26. A second level sensor 44*b* is shown mounted at a greater height level above which the controller U1 may determine that refilling is no longer required and the fill valve 24 may be closed. However, a single level sensor may be used for both operations and various combinations of level sensors as described above may be utilized for other operations of the water-dispensing device 10, as desired.

At step 114, the controller U1 may monitor whether the water dispensing operation is complete. For example, the controller U1 may determine whether a predetermined time period for dispensing has elapsed, or whether the user has released the water dispensing actuator 14, or the like. Once the controller U1 determines that the water dispensing operation is complete, at step 116, the controller U1 may close the appropriate dispense valve 32*a*, 32*b*. At step 118, the controller U1 may deactivate the dispense pump 30. With respect to hot water dispensing operations, this may further include closing the control valve 42 to the hot water tank 28. In some embodiments, after dispensing hot water, the hot water tank 28 may need to be refilled to a desired level. In such embodiments, the dispense pump 30 may continue to run (and, if necessary, the control valve 42 may remain open) for a time after the second hot dispense valve 32*b* is closed.

At step 120, the controller U1 may deactivate the melt pump 40. At step 122, when the ice maker 34 is actively making ice, the controller U1 may allow the ice making valve 38 to remain open to allow the ice maker 34 to be replenished with water. At step 124, the controller U1 may monitor a level of water in the melt tray 37 as a way to determine the fill status of the ice maker 34. The melt tray 37 may include one or more level sensors 46, such as float sensors, optical sensors, inductive-type sensors, capacitive-type sensors, combinations thereof, or the like, for detecting a level of water in the melt tray 37. Where different water levels may trigger different actions, individual level sensors may be provided at each level. In other embodiments, a single level sensor may be able to detect multiple water levels—such as where a pivotable float may rise with the water level and contact individual pins associated with predetermined water levels. When the controller U1 has determined that the water in the melt tray 37, based on the level sensor 46, has reached a predetermined level, at step 126, the controller U1 may close the ice making valve 38. However, it may be desirable to leave the ice making valve 38 open even afterward if the ice maker 34 is actively making ice. Therefore, the fill status signal received by the controller U1 may only be one condition of several leading to the closure of the ice making valve 38 in step 126. Although FIG. 2 shows a single level sensor 46, multiple level sensors or combinations thereof may be deployed for the above-described operation and others, as desired.

Recycling of the water from the melt tray 37 and ice maker 34 may occur outside of water dispensing operations as well. For example, the level sensor 46 (or one of several level sensors in the melt tray 37 in certain embodiments) may be placed or utilized to detect that water in the melt tray 37 has exceeded a predetermined level. Upon receiving a signal from the level sensor 46 that the controller U1 determines indicates the water level in the melt tray 37 is too high, which may occur due to melting ice and/or the flow from the ice maker 34, the controller U1 may activate the melt pump 40 to move water from the melt tray 37 back to the reservoir tank 26.

Referring again to FIG. 2, in some embodiments, it may be desirable to place the ice maker 34 in fluid communication with a drain 50, such as a drain pipe, sewage line, or the like, such as when the water has a high hardness level or other characteristics that would make it necessary to periodically drain old water in the system. The ice maker 34 may therefore connect to a drain pump 52. The controller U1 may be configured to periodically activate the drain pump 52 to remove water from the ice maker 34 toward the drain 50. For example, the drain pump 52 may be activated four times a day, although other periods may be used or selected, depending on conditions and/or user preferences. However, it is preferable to avoid activation of the drain pump 52 while the ice maker 34 is actively making ice. For example, prior to drain pump 52 activation, the controller U1 can determine whether the ice maker 34 is active, and if so, delay activation of the drain pump 52 until such time as the ice maker 34 becomes inactive.

In some embodiments, the water-dispensing device 10, and particularly the controller U1, may be configured for wired communication (e.g., via USB, Ethernet, IEEE 1394, or the like) or wireless communication (e.g., via WI-FI, BLUETOOTH, ZIGBEE, Z-WAVE, 3G, 4G, or 5G cellular, infrared, or the like) with an external device (not shown), such as a smartphone, laptop, tablet, desktop, or the like. A user may be able to access features and operations of the water-dispensing device 10 through a web browser, a software application installed on the external device, or the like.

In some embodiments, certain aspects of the operation by the controller U1 can be selected or changed using the operation panel 16.

Those skilled in the art will recognize that boundaries between the above-described operations are merely illustrative. The multiple operations may be combined into a single operation, a single operation may be distributed in additional operations and operations may be executed at least partially overlapping in time. Further, alternative embodiments may include multiple instances of a particular operation, and the order of operations may be altered in various other embodiments.

While specific and distinct embodiments have been shown in the drawings, various individual elements or combinations of elements from the different embodiments may be combined with one another while in keeping with the spirit and scope of the invention. Thus, an individual feature described herein only with respect to one embodiment should not be construed as being incompatible with other embodiments described herein or otherwise encompassed by the invention.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined herein.

We claim:

1. A water-dispensing device comprising:

a reservoir tank;

a dispense pump connected to the reservoir tank;

one or more dispense valves downstream of the dispense pump;

a spigot in selective fluid communication with the reservoir tank via at least the dispense pump and the one or more dispense valves;

an ice maker;

an ice making valve disposed between the reservoir tank and the ice maker to enable selective fluid communication from the reservoir tank to the ice maker;

an ice tank configured to receive and store ice made by the ice maker, the ice tank including a melt tray that is in fluid communication with the ice maker;

a melt pump connected between the melt tray and the reservoir tank; and a controller configured to, upon receiving a signal to perform a water dispensing operation:

(a) open one of the one or more dispense valves, (b) activate the dispense pump to move water from the reservoir tank toward the spigot, (c) if the ice making valve is not open, open the ice making valve, and (d) activate the melt pump to move water from the melt tray toward the reservoir.

2. The water-dispensing device of claim 1, wherein the one or more dispense valves includes a first dispense valve and a second hot water dispense valve.

3. The water-dispensing device of claim 2, further comprising a hot water tank located between the reservoir tank and the second hot water dispense valve, the dispense pump being located between the reservoir tank and the hot water tank, the hot water tank being in selective fluid communication with the second hot water dispense valve.

4. The water-dispensing device of claim 3, further comprising a control valve located between the dispense pump and the hot water tank, the controller being configured to open the control valve when the water dispensing operation is a hot water dispensing operation.

5. The water-dispensing device of claim 1, further comprising a fill valve located upstream of the reservoir tank, the fill valve being configured to place the reservoir tank in selective fluid communication with a water source.

6. The water-dispensing device of claim 5, wherein the reservoir tank includes a level sensor.

7. The water-dispensing device of claim 6, wherein the controller is further configured to, upon receiving a signal from the level sensor in the reservoir tank indicating a low level condition, open the fill valve to allow water from the water source to enter the reservoir tank.

8. The water-dispensing device of claim 1, wherein the melt tray includes a level sensor.

9. The water-dispensing device of claim 8, wherein the controller is further configured to, in response to receiving a signal from the level sensor in the melt tray indicating a level of water in the melt tray has exceeded a predetermined level, activate the melt pump to move water from the melt tray to the reservoir tank.

10. The water-dispensing device of claim 8, wherein the controller is further configured to, upon determining that the water dispensing operation is complete:

(i) deactivate the dispense pump and the melt pump, (ii) close the one of the one or more dispense valves, and (iii) leave the ice making valve open at least until receiving a signal from the level sensor in the melt tray indicating that the melt tray is full.

11. The water-dispensing device of claim 1, further comprising a drain pump connected to the ice maker and connectable to a drain.

12. The water-dispensing device of claim 11, wherein the controller is further configured to periodically activate the drain pump to move water from the ice maker toward the drain.

13. A method of operating a water-dispensing device including a reservoir tank, a dispense pump, one or more dispense valves downstream of the dispense pump, a spigot, an ice maker, an ice making valve disposed between the reservoir tank and the ice maker to enable selective fluid communication therebetween, an ice tank having a melt tray in fluid communication with the ice maker, a melt pump, and a controller, the method comprising:

in response to receiving, by the controller, a signal to perform a water dispensing operation:

opening, by the controller, one of the one or more dispense valves;

activating, by the controller, the dispense pump to move water from the reservoir tank toward the spigot;

checking, by the controller, a status of the ice making valve and, if the ice making valve is closed, opening the ice making valve; and activating, by the controller, the melt pump to move water from the melt tray toward the reservoir.

14. The method of claim 13, wherein the water-dispensing device further includes a hot water tank, the method further comprising, when the water dispensing operation is a hot water dispensing operation, opening a control valve located between the dispense pump and the hot water tank.

15. The method of claim 13, further comprising, upon receiving a signal from a level sensor in the reservoir tank indicating a low level condition, opening, by the controller, a fill valve to allow water from a water source to enter the reservoir tank.

16. The method of claim 13, further comprising, upon receiving a signal from a level sensor in the melt tray indicating a level of water in the melt tray is too high, activating, by the controller, the melt pump to move water from the melt tray to the reservoir tank.

17. The method of claim 13, further comprising, upon determining, by the controller, that the water dispensing operation is complete:

deactivating the dispense pump and the melt pump;

closing the one of the one or more dispense valves; and leaving the ice making valve open at least until receiving a signal from a level sensor in the melt tray indicating that the melt tray is full.

18. The method of claim 13, wherein the water-dispensing device includes a drain pump connected to the ice maker, the method further comprising activating, by the controller on a periodic basis, the drain pump to move water from the ice maker toward the drain.

* * * * *